US005884887A

United States Patent [19]

Garelick et al.

[11] Patent Number: 5,884,887

[45] Date of Patent: Mar. 23, 1999

[54] LOCK FOR SLIDE ADJUSTMENT OF BOAT SEAT OR TABLE TOP

[75] Inventors: Richard J. Garelick, Minneapolis; Paul A. Pilosi, Minnetonka, both of Minn.

[73] Assignee: Garelick Mfg. Co., St. Paul Park, Minn.

[21] Appl. No.: 888,548

[22] Filed: Jul. 7, 1997

Related U.S. Application Data

[60] Provisional application No. 60/037,215 Feb. 5, 1997.

[51] Int. Cl. [6] ..... F16M 13/00

[52] U.S. Cl. ..... 248/423; 248/416; 297/344.1; 297/451.5

[58] Field of Search ..... 248/423, 279.1, 248/286.1, 674, 678, 393, 416, 424, 178.1, 188.1, 219.2, 298.1; 108/137, 143, 150; 297/344.1, 344.11, 451.5, 344.13, 411.35, 411.37, 115

[56] References Cited

U.S. PATENT DOCUMENTS

| | | | |
|---|---|---|---|
| 2,673,592 | 3/1954 | Caramelli | 248/416 |
| 3,321,165 | 5/1967 | Wann | 248/553 |
| 3,517,624 | 6/1970 | Helms | 108/137 |
| 3,542,326 | 11/1970 | Reapsummer | 248/413 |
| 3,822,049 | 7/1974 | Saunders | 248/203 |
| 4,706,919 | 11/1987 | Soberalski | 248/281.1 |
| 5,131,718 | 7/1992 | Cooper | 297/344 |
| 5,171,063 | 12/1992 | Stidd | 297/344 |
| 5,374,102 | 12/1994 | Archambault et el. | 297/344.13 |
| 5,522,641 | 6/1996 | Infanti | 297/344.13 |
| 5,681,116 | 10/1997 | Lin | 384/42 |
| 5,732,994 | 3/1998 | Stancu | 296/37.8 |

OTHER PUBLICATIONS

Pp. 22–24 Garelick Marine Products Catalog Copyright 1996.

*Primary Examiner*—Derek J. Berger
*Assistant Examiner*—Gwendolyn Baxter
*Attorney, Agent, or Firm*—Jacobson and Johnson

[57] ABSTRACT

For a slidably adjustable boat seat or table top, a first plate member for carrying a seat or table top has a pair of underside tracks along parallel outer edges which are slidably engaged or mated with edges of a supporting plate member. One edge of the supporting plate has a series of recesses and there is a cam toothed rod mounted in the mating track which is rotatably spring-biased to rotate the rod to bring the teeth and the recesses into engagement to lock the plates together and a lever handle attached to the rod is provided to manually rotate the rod to disengage the teeth for slidably adjusting the seat position.

6 Claims, 4 Drawing Sheets

LOCK FOR SLIDE ADJUSTMENT OF BOAT SEAT OR TABLE TOP

This application claims the benefit of U.S. Provisional Application No. 60/037,215 filed Feb. 5, 1997.

FIELD OF THE INVENTION

Boat seats (and sometimes table tops) are normally mounted on a supporting member which is anchored to the deck of the boat but must be adjustable fore and aft or forward or backward to accommodate the user. After adjustment, the seat should be locked securely in place so it cannot move back and forth and does not wobble. This invention is aimed at providing such a locking mechanism in a fashion that is convenient and easy to use.

DESCRIPTION OF THE PRIOR ART

A previously commercially available adjustable boat seat with lock mechanism utilized a pair of slidably engaged plate members with the boat seat attached to the upper plate member and the lower plate member anchored in some fashion to the boat deck. A handle at the end of a radially extended threaded rod which is threadably engaged in the side of one of the plate members is turned to thread the rod into the plate member to force the opposite edge of the engaged plate members into snug frictional engagement to lock the two plate members together so they won't slide with respect to one another. While successful, this commercially available device was somewhat awkward for the user to operate and did not have a solid anti-slide locking arrangement. Other commercially available slidably adjustable boat seats with manually operable locking mechanisms operated on totally different principles.

SUMMARY OF THE INVENTION

A first plate member which is adaptable to hold a boat seat or table top has a pair of parallel tracks on its underside along opposite edges to receive in sliding engagement parallel edges of another plate member which is anchored in some fashion to the boat deck. One edge of the second plate member is smooth, the other edge has a series of spaced apart recesses or indentations. An elongated toothed rod is located in the track of the first plate member in which the indented edge of the second plate member is engaged. A helically wound spring is attached to the rod to bias axial rotation of the rod to bring the rod teeth in a direction to engage the recesses in the edge of the second plate member to positively lock the two plate members together so they cannot slide fore and aft with respect to one another. In addition, the teeth are cammed so that they apply a lateral force so that the opposite track of the one plate member is brought into snug frictional engagement with the smooth edge of the other plate member thereby further preventing any sliding between the two plate members and also virtually eliminating any wobble. A lever-like handle attached at or near one end of the rod is used for manually rotating the rod against the force of the spring so the teeth are disengaged from the recesses in the second plate member to allow the seat (or table top) to be slidably adjusted fore or aft.

As a further feature, the track in which the smooth edge of the second plate member is engaged is angled to ensure a snug frictional fit between the edge of the second plate member and the track, yet when the lock is disengaged the second plate member will slide smoothly and easily within the tracks.

DESCRIPTION OF THE PREFERRED EMBODIMENTS

Figure 1:
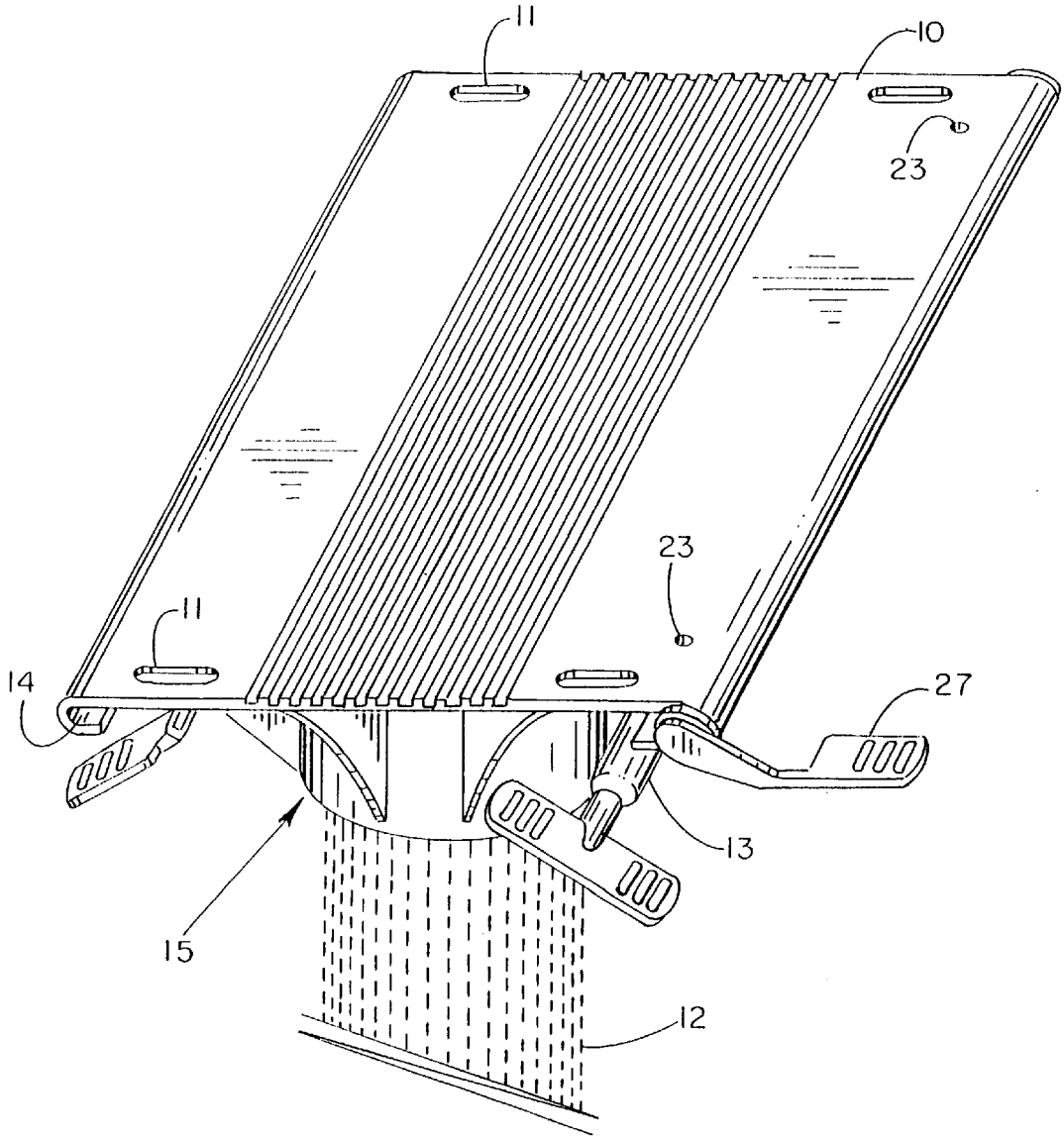
FIG. 1 is a top perspective view of an assembly for a slidably adjustable boat seat incorporating a preferred form of the invention.
Figure 2:
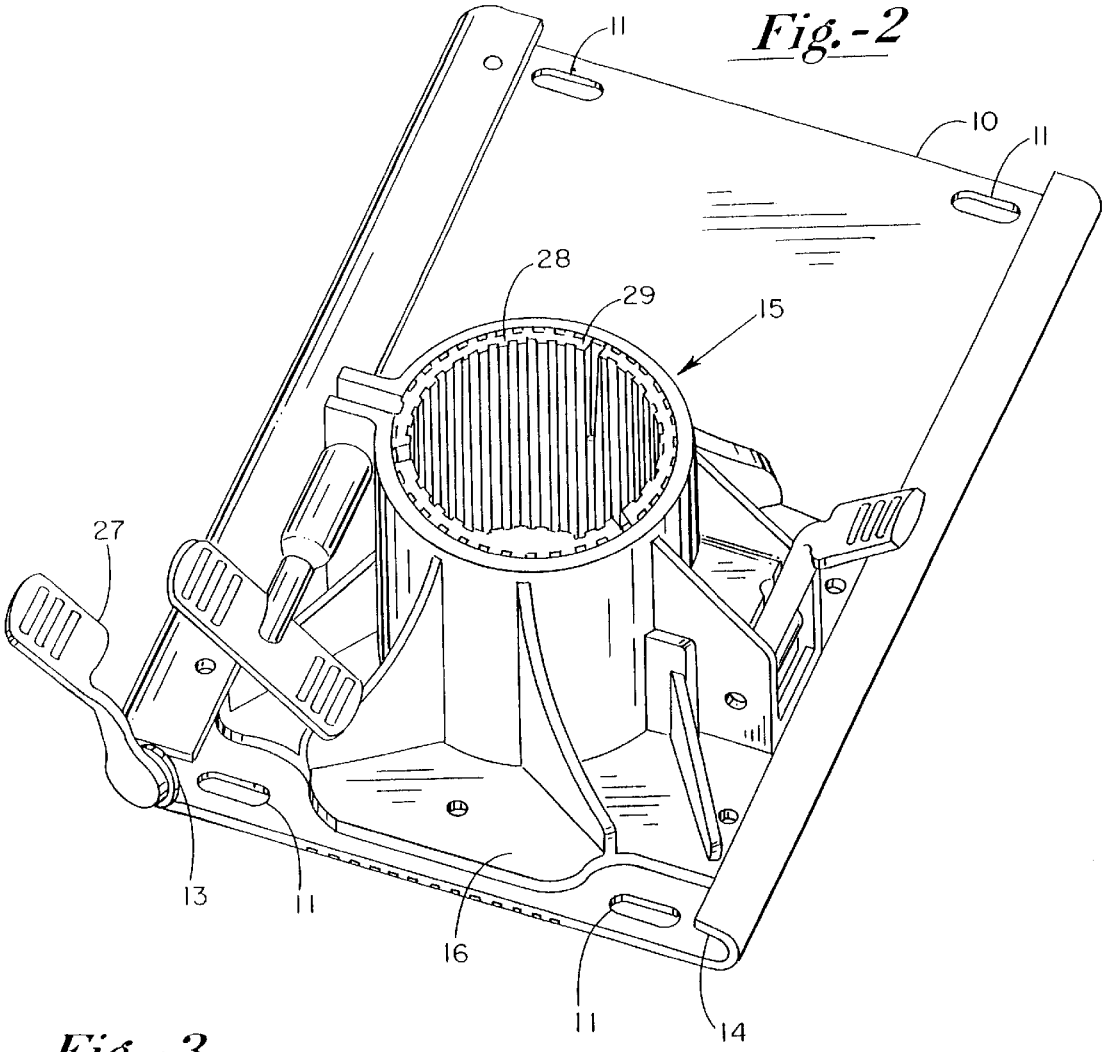
FIG. 2 is an underside perspective view.
Figure 3:
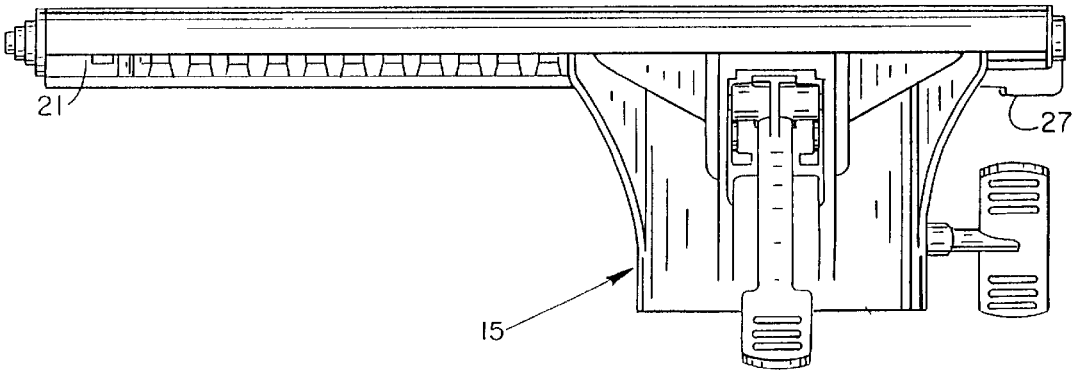
FIG. 3 is a side elevational view.
Figure 4:
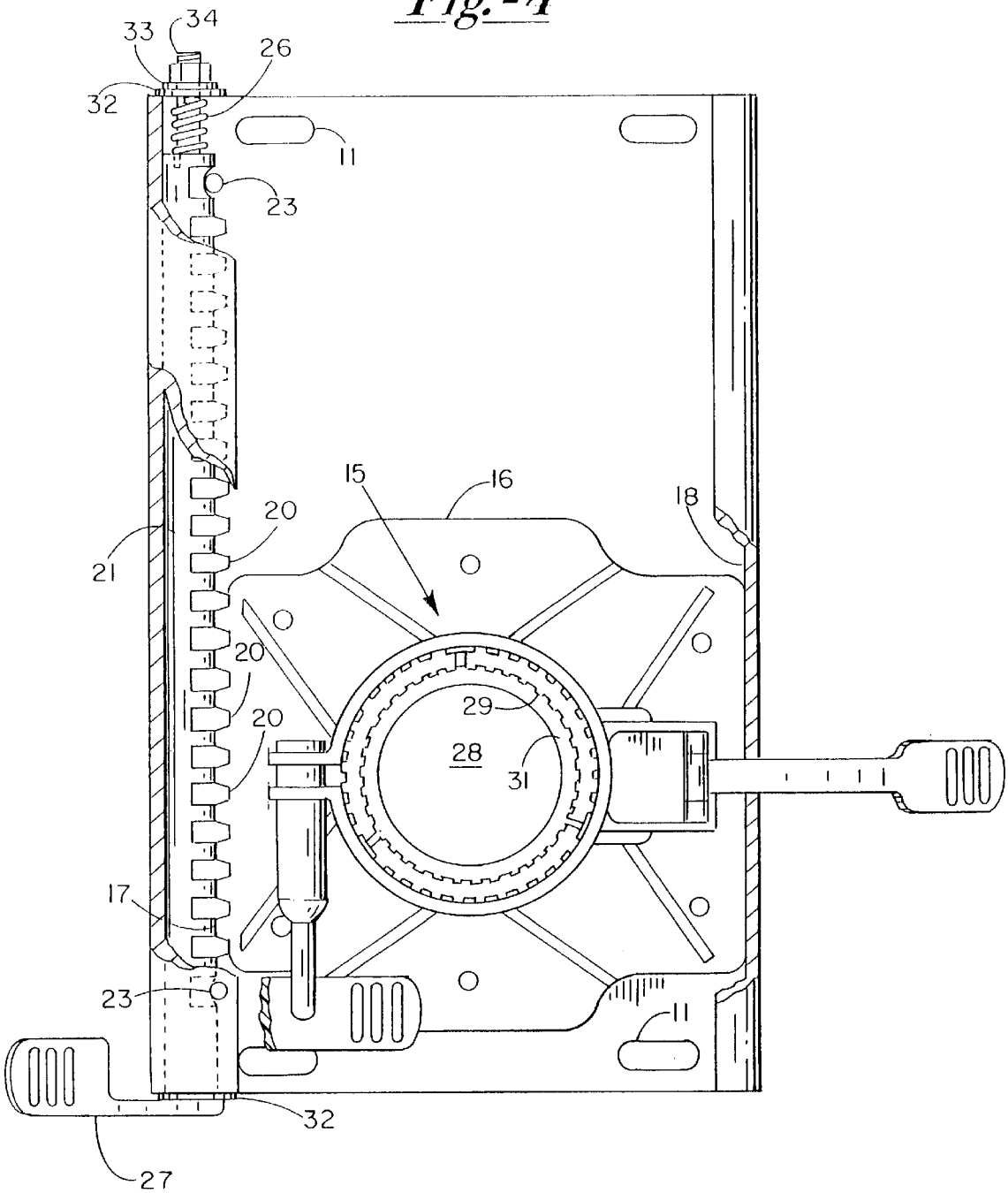
FIG. 4 is a bottom view.

A generally rectangular rigid plate member 10 has a number of openings 11 through which mounting bolts can be inserted to thread into the underside of a boat seat (or table top) (not shown) in a conventional fashion for attaching the boat seat. In a manner which will be described in greater detail later the seat may be supported in an elevated position by a support column or post 12 shown in shadow line which is anchored to the boat deck and which is coupled to plate member 10 via a spider or yoke 15.

Along two opposite parallel side edges plate 10 is curved underside to form a pair of tracks 13 and 14. A second plate member 16 which is integrally formed as part of a single casting with yoke 15 is engaged along two opposite side edges 17 and 18, respectively, in tracks 13 and 14. Edge 17 has a series of spaced-apart recesses or notches 20 and edge 18 is smooth. An elongated rod 21 having a series of spaced-apart teeth 25 is mounted lengthwise in track 13 and is axially rotatable within track 13. Roll pins, not shown, inserted through openings 23 in plate 10 engage recesses 24 to prevent rod 21 from sliding lengthwise out of track 13. A helical spring 26 is wrapped around rod 21 near one end and is in torsion. One end of spring 26 is inserted into rod 21 and the other end inserted into plate 10 so that spring 26 biases rod 21 to rotate it axially in a direction so that the teeth 25 on rod 21 are engaged with the recesses 20 on the edge 17 of plate 16. A lever-like handle 27 is attached to an end of rod 21 and extends outward from the plate member 10. Rod 21 is free floating in track 13. It is held in track 13 by a combination of a nylon washer 32 at each end, a stainless steel washer 33 and a nut 34 threaded onto the threaded end 35 of rod 21.

In use the operator moves handle 27 in a direction opposite the bias applied by spring 26 to rotate rod 21 so that the teeth 25 are disengaged from recesses 20. This allows plate member 10, with the attached seat or table top, to be moved fore and aft or backward or forward. At the desired location or position, handle 27 is released so that spring 26 acts to turn or rotate rod 21 so that the teeth 25 engage recesses 20 of plate 16 thereby providing a positive locking against any further sliding or fore and aft movement. If the teeth 25 are resting against the ridges between the recesses 20, the operator merely moves the seat slightly so that the plate member 10 moves until teeth 25, under the force provided by spring 27, click or snap into the recesses 20 to lock the seat in place.

Figure 5:
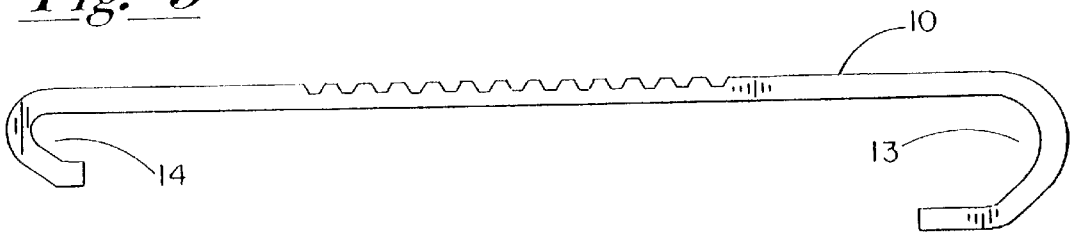
FIG. 5 is an end view of one of the plate members utilized in the invention.
Figure 6:
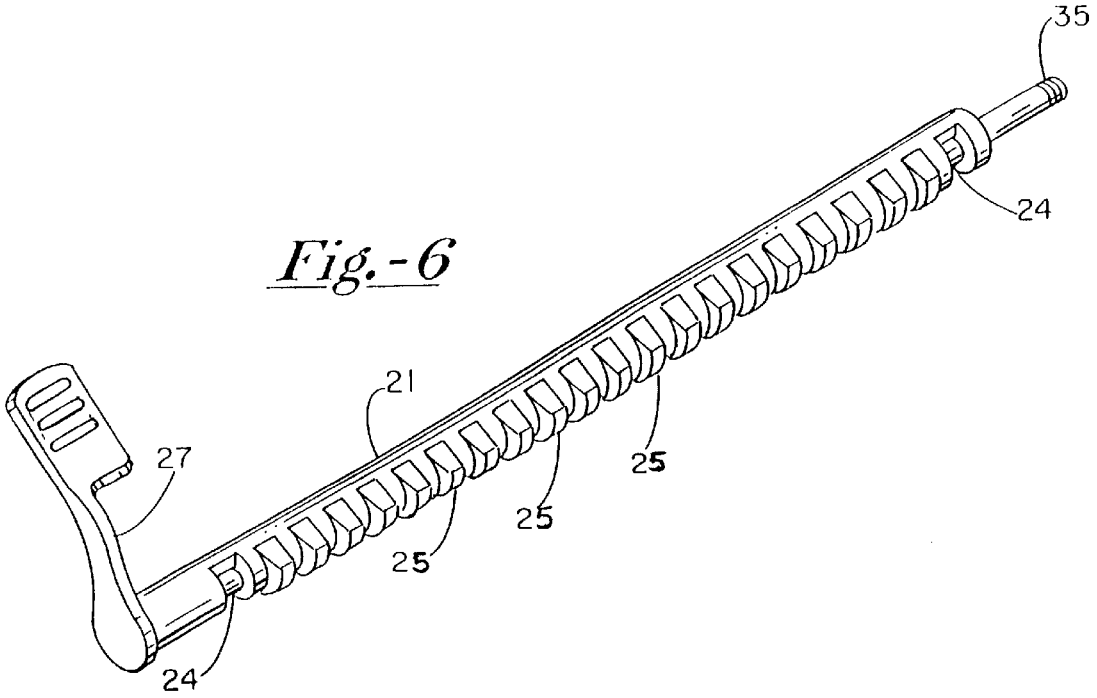
FIG. 6 is a perspective view of a toothed rod utilized in the invention.

Teeth 25 are cam shaped so when engaged in recesses 20 they not only provide a positive locking against sliding action between plate members 10 and 16 but also apply a lateral force so that the opposite track 14 on the underside of plate member 10 is brought into very snug or tight frictional engagement with the smooth edge 18 of plate member 16 to eliminate the possibility of the seat "wobbling". As most clearly seen in FIG. 5, track 14 is tapered or angled to provide the snug or fight frictional fit against the edge 18 of plate member 16 yet will allow plate member 10 to slide easily for seat adjustment when handle 27 is moved to unlock the plates from one another.

Yoke or spider 15 has a central or annular opening 28 with an annular insert designated by reference numeral 29. Insert 29 has an upper lip or flange 31 which rests against the underside of an overhang on plate member 16. The supporting column 12 which, as mentioned earlier, is suitably anchored to the boat deck is also inserted into opening 28 and it has an outer notched surface which engages the internal notches on insert 29 and its top edge rests against the underside of flange 31. The boat seat is rotatable or swivable about the support post to change the direction that the seat faces. A locking mechanism, not shown, is provided to secure the seat when it is facing in the desired direction.

Alternatively, plate member 16 can be mounted in some suitable fashion more directly to the deck of the boat without a supporting column or post. This is referred to as a low profile mount for a boat seat or table top. Also glide pads or a glide gasket or similar made of some suitable plastic material such as Delrin may be mounted in some suitable fashion between plate members 10 and 16 to act as a spacer and to ensure that the plate members slide smoothly and easily when the seat is being slidably adjusted.

We claim:

1. A blocking mechanism for a slidably adjustable boat seat or table top, comprising:

a first generally rectangular rigid plate member adapted for attachment to the underside of the seat or table top;

a second generally rectangular rigid plate member adapted for attachment to a supporting surface;

said first plate member having two elongate opposite edges curved underside to provide parallel tracks;

said second platte member having a series of spaced-apart recesses along one edge slidably engaged in one of said tracks and an opposite smooth edge slidably engaged in the other track;

an elongated rod having a series of teeth therealong axially rotatably mounted in said one track;

a spring rotatably biasing said rod so the rod teeth engage said recesses; and a handle attached to said rod extending outward beyond the one edge of said first plate member for manually rotating said rod to move the rod teeth out of engagement with the recesses in said second plate member.

2. The locking mechanism for the slidably adjustable boat seat or table top as described in claim 1 wherein:

the teeth on said toothed rod are cammed;

said cammed teeth when engaged with said recessed edge applying a lateral force against the edge of said second plate member to bring the other track on said first plate member into snug frictional engagement with the smooth edge of said second plate member.

3. The locking mechanism for the slidably adjustable boat seat or table top as described in claim 2 wherein said other track on said first plate member is angled to snugly engage the smooth edge of said second plate member when said plate members are releasably locked together.

4. A locking mechanism for a slidably adjustable boat seat or table top, comprising:

a generally rectangular rigid plate member adapted for attachment to the underside of the seat or table top;

a generally rectrangular rigid plate member adapted for attachment to a supporting surface;

one of said plate members having elongated tracks formed on two opposite edges;

the other of said plate members having a series of spaced-apart recesses along one edge slidably engaged in one of said tracks and an opposite smooth edge slidably engaged in the other track;

an elongated rod having teeth therealong axially rotatably mounted in said one track;

a spring rotatably biasing said rod so the rod teeth engage said recesses; and a handle attached to said rod extending outward from said one track for manually rotating said rod against the spring bias to move the rod teeth out of engagement with said recesses.

5. The locking mechanism for a slidably adjustable boat seat or table top as described in claim 4 wherein:

the teeth on said rod are cammed;

said cammed teeth when engaged with said recesses applying a lateral force against the edge of said other plate member to bring the other track on said one plate member into snug frictional engagement with the smooth edge of said other plate member.

6. The locking mechanism for the slidably adjustable boat seat or table top as described in claim 5 wherein said other track on said one plate member is angled to snugly engage the smooth edge of said other plate member when said plate members are releasably locked together.

* * * * *